United States Patent [19]

Louis

[11] 3,952,411

[45] Apr. 27, 1976

[54] MULTI-WIRE WIPER CONTACT FOR POTENTIOMETERS AND OTHER ELECTROMECHANICAL DEVICES AND METHOD FOR MAKING SAME

[75] Inventor: Arnold S. Louis, Hastings-on-Hudson, N.Y.

[73] Assignee: Litton Systems, Inc., Beverly Hills, Calif.

[22] Filed: Sept. 30, 1974

[21] Appl. No.: 510,794

[52] U.S. Cl. ..... 29/630 E; 29/630 R

[51] Int. Cl.[2] ..... H01R 9/00

[58] Field of Search ..... 29/630 E, 630 R, 629, 29/622, 423, 604, 193.5; 156/2, 7, 18; 338/202, 183, 180; 200/237, 252, 260; 242/7.03, 7.06, 7.17

[56] References Cited

UNITED STATES PATENTS

| | | | |
|---|---|---|---|
| 1,865,256 | 6/1932 | Johannesen | 242/7.03 |
| 3,631,592 | 1/1972 | Wilson | 29/604 |
| 3,653,121 | 4/1972 | Moriyama et al. | 29/604 |
| 3,733,573 | 5/1973 | Dieterich | 29/630 E |
| 3,755,892 | 9/1973 | Dieterich | 29/630 E |
| 3,766,646 | 10/1973 | Froebe et al. | 29/630 E |
| 3,773,628 | 11/1973 | Misawa et al. | 156/18 |
| 3,779,842 | 12/1973 | Grunwald et al. | 156/18 |
| 3,795,884 | 3/1974 | Kotaka | 339/17 LM |
| 3,818,414 | 6/1974 | Davies et al. | 339/17 M |
| 3,852,878 | 12/1974 | Munro | 29/629 |

*Primary Examiner*—C. W. Lanham
*Assistant Examiner*—James R. Duzan
*Attorney, Agent, or Firm*—M. Michael Carpenter; Alan C. Rose; Alfred B. Levine

[57] ABSTRACT

A multi-wire wiper contact is shown formed from a plurality of conductive and nonconductive wires wrapped about a mandrel to form a flat set of wires helically wrapped into a coil. The wire coil is then masked with a desired pattern and the unmasked wire is plated with a conductive metal. The metal plate which forms on the unmasked portions of the wire does not form on those unmasked wires which are nonconductive. After plating, the masking is removed, one set of wire is cut, and the wire set and plated portions holding that set are removed from the mandrel in a continuous flat strand of wire with the nonconductive wire forming a parting line for the strand. The nonconductive wire is removed from the strand and the strand is then cut and shaped into a multi-wire wiper contact for use in potentiometers and other electromechanical devices.

8 Claims, 13 Drawing Figures

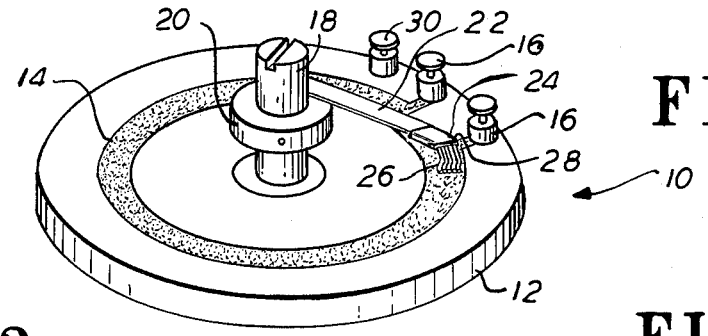
FIG. 1
FIG. 3
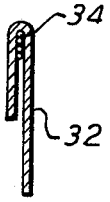
FIG. 2
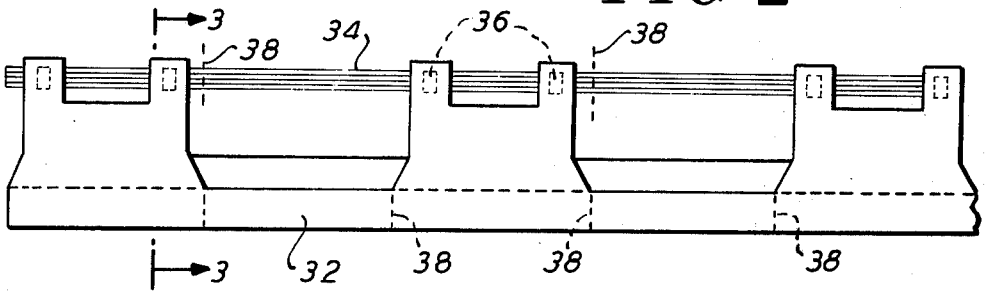
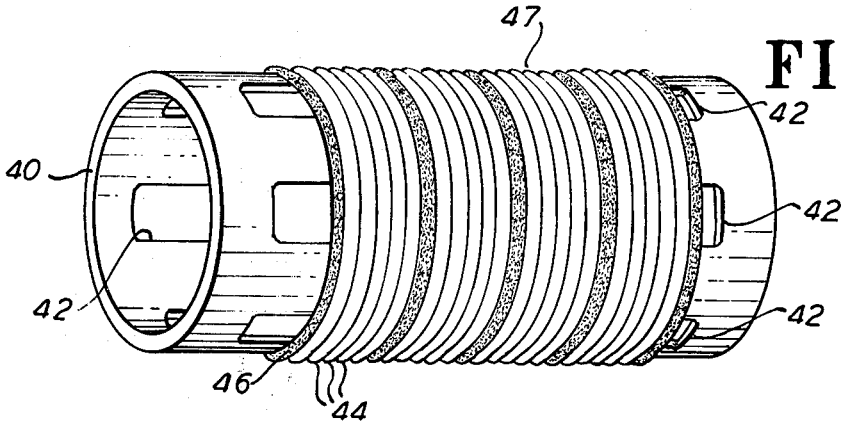
FIG. 4
FIG. 4A
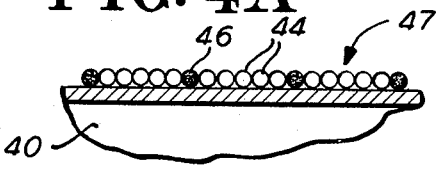
FIG. 4B
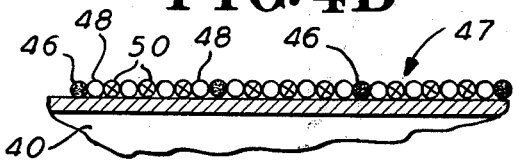
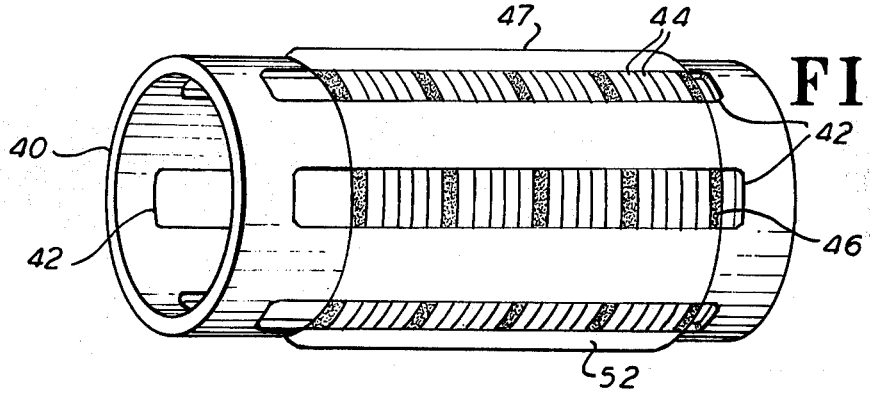
FIG. 5

MULTI-WIRE WIPER CONTACT FOR POTENTIOMETERS AND OTHER ELECTROMECHANICAL DEVICES AND METHOD FOR MAKING SAME

BACKGROUND OF THE INVENTION

The present invention relates to a multi-wire wiper contact for use in a potentiometer or other electromechanical device and, more particularly, to a method of wrapping conductive and nonconductive wire upon a mandrel to form a set of wires helically wrapped into a coil prior to masking and plating the coil to form a subassembly that, after plating, may be continuously unwound from the mandrel as a flat strand which can be subsequently formed into multi-wire wiper contacts.

It is known in the prior art to provide a potentiometer with a wiping arm having multiple spring contact fingers which slidably engage the resistive element thereof. An example of such a multiple wire contact is shown in U.S. Pat. No. 2,760,063 by R. C. Raymer in which noble metal wire is wound upon a carbon rod prior to plating the entire wire coil with copper. A portion of the plated wire coil is then masked with an acid resist and the copper plate is removed from the unmasked areas by etching. The exposed portions of the noble metal wire coil, now joined by copper, are then cut and shaped into the desired contact form.

In my U.S. Pat. No. 3,328,707, a second approach is disclosed for forming a multi-wire wiper contact through the utilization of a plurality of wires having a flattened cross section. My patent teaches the idea of attaching the individually flattened wires to a clip by soldering the wires thereto. Contrary to the interpretation of some, the wiper contacts were formed in a continuous chain by folding a stamped piece of sheet metal about a parallel strand of individual wires. The sheet metal piece was first stamped to form a repeat pattern in the configuration of the clamp and then folded over the parallel strands of wire prior to attaching the wire thereto as by welding or solder. The multi-pattern sheet metal and wire was then cut to form the individual multi-wire wiper contact shown in my U.S. Pat. No. 3,328,707.

Since the issuance of my patent, the size of miniature potentiometers has continued to decrease. The potentiometer and multi-wire wiper assembly described in my patent and developed a decade ago are too large and too expensive for many of today's devices. After considering the approach of others, including: those shown in U.S. Pat. No. 3,579,822 by F. J. Dieterich; U.S. Pat. No. 3,704,436 by R. L. Froebe, et al; and U.S. Pat. No. 3,733,573 by F. L. Dieterich, I conceived an improvement over the device disclosed in my earlier patent which provides for a multi-wire wiper contact similar to that shown in the patents referenced above but eliminates procedural steps required in those patents.

SUMMARY OF THE INVENTION

The present invention provides for a miniaturized low-cost multi-wire wiper contact which may be mass produced by automated machinery.

The present invention wraps conductive and nonconductive wire about a mandrel to form a set of wires which is helically repeated as the set creates a wire coil. The wrapped coil is then masked in longitudinal strips circumferentially spaced about the mandrel and the unmasked portions are plated. After removal of the mask, it will be found that the plated strips which parallel the longitudinal axis of the mandrel are interrupted by the nonconductive wire against which no plating was formed. A wire set is then unwound from the coil by detaching a first set of conductive wires and the first nonconductive wire and uncoiling the resulting strand from the mandrel. The strand may then be stamped and cut into the shape and length desired to form a multi-wire wiper contact.

Another embodiment of the present invention may be provided by wrapping a set of noble metal and copper wires alternately in each wire set and separating each set with a nonconductive wire. The steps outlined above are repeated with an additional step of placing the plated mandrel into an acid bath which etches away the cooper wire and leaves the noble metal wire separated by the spacing of the copper wire. The first helix of noble metal wires are then cut and the resulting strand uncoiled from the mandrel.

DESCRIPTION OF THE DRAWINGS

A better understanding of the present invention, its objects and appendant advantages will be obtained by reference to the following description when considered in connection with the accompanying drawings, wherein:

FIG. 1 is a perspective view showing a typical potentiometer in which the present invention may be utilized;

FIG. 2 is a side view showing a sheet metal strip clamped about a plurality of wires used in the prior art to form a multi-wire wiper contact;

FIG. 3 is a cross-sectional view taken along lines 3—3 of FIG. 2;

FIG. 4 is a perspective view showing a mandrel about which multiple strands of wire have been wrapped;

FIG. 4A is a cross-sectional view of the mandrel of FIG. 4 illustrating one arrangement of wire;

FIG. 4B is a cross-sectional view of FIG. 4 showing a second arrangement of wire;

FIG. 5 is a perspective view of the mandrel after the wire coil thereon has been masked;

DESCRIPTION OF THE PREFERRED EMBODIMENTS

Figure 5A:
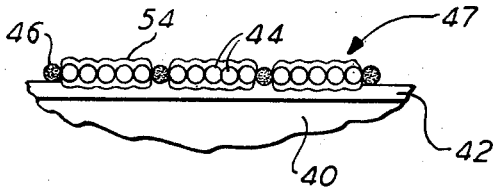
FIG. 5A is a cross-sectional view taken from FIG. 5 showing one arrangement of a wire coil after plating.

Referring now to the drawings, FIG. 1 illustrates, by way of example, a rotary potentiometer 10 having a ceramic substrate 12 upon which a conductive resistance track 14 has been comolded. A plurality of terminals 16 are radially disposed upon the substrate 12 to provide an electrical path between opposite ends of the conductive resistance track 14 and an external utilization device. A shaft 18 extends from the center of the substrate 12 in which it is supported by suitable rotating means such as a bearing, not shown. A collar 20 is attached to the shaft 18, as by a set screw, for supporting a wiping arm 22 having a multi-wire wiper contact 24 attached to the end thereof as by welding. The multi-wire wiper contact 24, best seen in FIG. 8, consists of a plurality of fine spring wires 26 attached, as by plating, to a base number 28 which in turn may be welded to the arm 22. The wires 26 of wiper contact 24 thus ride across the surface of the resistance track 14 as the shaft 18 is rotated. As is well known in the prior art, there are several advantages of multiple finger contacts over a single contact including improved wear, improved contact reliability and improved contact continuity. Terminal 30 is connected to the wiper contact 24 via arm 22, shaft 18 and shaft wiping means, not shown.

The potentiometer described hereinabove with reference to FIG. 1 has been fully described in my issued U.S. Pat. No. 3,328,707. Referring now to FIGS. 2 and 3, there is shown a production procedure whereby the wiper contact 24 of FIG. 1 has been mass produced. This process of mass production was accomplished by providing a sheet of copper 32 which was stamped into the configuration desired and folded over a plurality of parallelly arranged, side-by-side conductive wires 34, as best seen in FIG. 3. After folding the copper sheet 32 about wires 34 and welding the wires to the sheet at the points indicated by dashed lines 36, the wiper contact 24 was completed by shearing along the shear line indicated by broken lines 38, FIG. 2. The resulting unitary wiper contact was then assembled to the wiper arm 22 by inserting the arm between the legs formed by the bent copper sheet 32 and welding the arm to the sheet.

While the method described above worked satisfactorily for several years, the increasing demand for smaller components and for components which may be manufactured from fully automated equipment at a corresponding reduction in cost made this method less desirable.

I thus set about to improve upon my method and in doing so developed a method for manufacturing multi-wire wiper contacts which lends itself to fully automated equipment. In order to make the multi-wire wiper contact as shown at 24 in FIG. 8, a tubular cylinder or mandrel 40 of suitable conductive material is provided with a series of longitudinal, circumferentially spaced slots 42 extending along the periphery thereof as shown in FIG. 4. Wound about the periphery of the mandrel 40 are parallel, side-by-side winds of conductive wire 44 such as conductive wire manufactured by the J. M. Ney Company and sold under the tradename "Paliney 7." In the example shown in FIG. 4, five spools of conductive wire are simultaneously wound upon the mandrel 40 to form the conduct wires 44 shown five abreast thereon. A sixth spool of insulated or nonconductive wire having the same diameter as the conductive wire is wrapped at the same time as the conductive wires 44 to provide an insulated or nonconductive wire 46. As is well known in the wire cable or rope art, the six spools may be fed through a common spool and wrapped upon the mandrel 40 for a length to be determined by the application desired to form a wire coil 47. Obviously, the number of turns of conductive wire may be varied from the five shown to four, to three, or to any other desired number depending upon the ultimate number of wires desired in the finished multi-wire wiper contact 24.

The five conductive wires 44 and the nonconductive wire 46 form a set of wire which is wrapped in a flat helix about the mandrel and which repeats its flat pattern every six wires, as best shown in FIG. 4A. This helical set of wires, forms a flat strand when later unwound from the coil 47, as described hereinbelow.

Referring to FIG. 4B, a second embodiment of the present invention is shown for ultimately producing a multi-wire contact 24 having spaced contacts. Such an arrangement may be accomplished by wrapping alternate side-by-side wires of conductive metal, one of which is etch resistant and one of which is easily etchable, upon the mandrel 40. For example, a first conductive wire of silver 48 or other noble metal is wrapped next to a conductive wire of copper 50. Each wire may be wound from its own spool, not shown, the number of which may vary depending upon the number of wires desired in each helical set. In FIG. 4B, there is shown four conductive, etch resistant wires of silver 48 and three conductive, easily etchable wires of copper 50; also shown is one insulated wire 46. All wires are wrapped on the mandrel 40, from separate spools to form a flat helix thereon which repeats every eight wires.

Referring to FIG. 5, the next step in my procedure includes the screen printing of transverse bars of insulator material 52 in a desired pattern across the conductive and nonconductive wires 44 and 46. In the embodiment shown, this insulated material 52 is sprayed through a screen, for example, onto the strands of wire opposite the solid portions of the mandrel 40 leaving the portions of the conductive wires traversing the longitudinal slots 42 exposed. The portions of the mandrel 40 not covered by wire are also sprayed with the insulator material 52. Alternately, the whole mandrel 40 may be covered with the insulator material 52 before the wire is wound upon the mandrel. Another alternative used in the present invention is to mask the full outer surface of wire coil 47 and allow a plated conductor to form only on the inner surface of the coil through the slots 42. The desired pattern of insulating material may also be formed upon the wire coil by use of a photoresist treatment and exposure to a light source, as is well known.

The mandrel assembly with its wire coil 47 and insulated material 52 is then placed in an electroplating bath of, for example, a copper or nickel solution. A metal anode, not shown, surrounds the wire coil 47 and mandrel 40 while the mandrel itself is made the cathode. The metal within the bath of the electroplating system is then plated upon the unmasked areas of the coil 47 by well known techniques for joining the conductive wires 44 in each repeat pattern of the flat strands whose helical wind forms the wire coil 47. It should be noted that the plating also deposits on the inner side of the conductive wires 44 through the longitudinal slots 42. However, the insulated or nonconductive wire 46 separates the repeat patterns as no plating takes place on this wire.

Figure 5B:
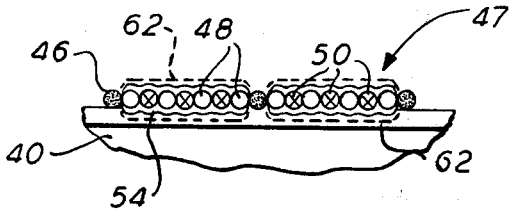
FIG. 5B is a second cross-sectional view taken from FIG. 5 showing another arrangement of the wire coil after plating.

After a desired plating thickness has been deposited upon the unmasked areas of the conductive wire, for example, between 0.1 and 1.0 times the wire diameter, the mandrel is removed from the plating bath, washed to remove all plating chemicals, and stripped of the insulator material 52. As a result, the conductive wire 44 is joined by a layer of plated joining metal 54, as shown in FIG. 5A where the mandrel 40 is shown as a section taken through one of the longitudinal slots 42.

It can be seen that the insulated or nonconductive wire 46 does not receive a plated layer of metal 54 as do the conductive wires 44. It will also be noted from FIG. 5A that the metal layer 54 holds the conductive wires 44 together such that the pattern of five conductive wires 44, separated by the insulated wire 46, is repeated.

Figure 6A:
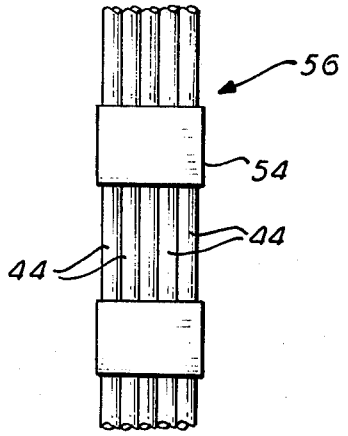
FIG. 6A is a side view illustrating a strand of wire such as that shown in FIG. 5A as that strand is uncoiled from the mandrel.
Figure 7:
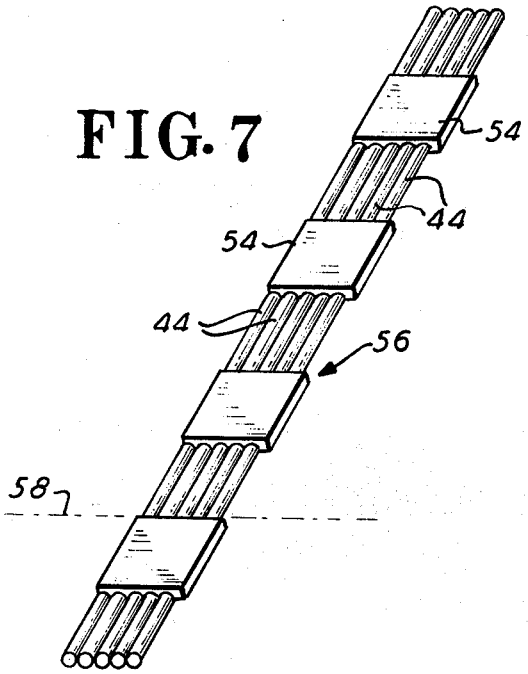
FIG. 7 is a perspective view of a typical strand of wire.

As the conductive and nonconductive wires 44 and 46 were wound upon the mandrel 40 in a continuous helix, it will be understood that these wires may now be cut parallel to the axis of the mandrel 40 and the five conductive wires 44 unwound from the wire coil 47 on the mandrel 40 as a continuous flat strand 56 shown best in FIGS. 6A and 7. As the flat strand 56 is unwound from the mandrel 40, it may be wound upon a suitable reel which provides an ideal feed for an automatic wire cutting and forming machine that forms the multi-wire wiper contact 24 shown in FIG. 8. The continuous flat strand 56 unwound from the mandrel 40 includes the plated metal portion 54 whose width equals the width of the five conductive wires 44. The nonconductive wire 46 is conveniently disposed of during the unwinding process.

Figure 8:
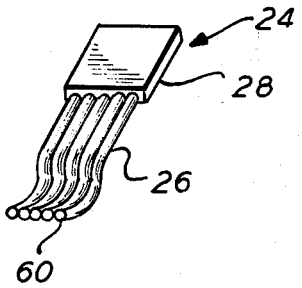
FIG. 8 is a perspective view of a multi-wire wiper contact.

The length of each multi-wire, flat strand 56 can be calculated as follows:

$$L = C \times \frac{1}{P} \times 1$$

where "C" equals the circumference of the mandrel, "P" equals the pitch of the helix as the strand is wound onto the mandrel, and "l" equals transverse length of wound portion on the mandrel. Thus, for example, a mandrel of 9.55 inches in diameter having a pitch of 0.065 inches and a length of 10 inches would yield 4,615 inches or 384 feet of flat strand material 56. Such an assembly when cut along the line indicated by broken line 58 and formed with curved outer wire ends 60, as shown in FIG. 8, would yield 16,000 wiper contacts 24 from a single wire coil 47. These wiper contacts are then heat-treated to produce the needed spring characteristics in the shaped wire ends 60, as is known in art.

As mentioned above, if it is desired to provide a wiper contact 24 with space apart spring contact wires, the mandrel 40 can be wrapped with alternate noble metal and conductive wires such as silver conductive 48 and copper conductive wires 50. After the mandrel 40 is wound with nonconductive wire 46, noble wire 48, and copper wire 50 in a continuous flat helix indicated by the pattern of FIG. 4B, the resulting wire coil 47 is masked and a pattern of insulator material 52 is placed thereon as described above. The mandrel is then plated with a suitable plating metal 54 for joining the wires. An etch resistant metal, such as silver, is added as a very thin layer 62, shown by dashed lines in FIG. 5B, over the joining metal 54. In this process, the mandrel 40 should also be plated with an etch resist such as silver.

Figure 6B:
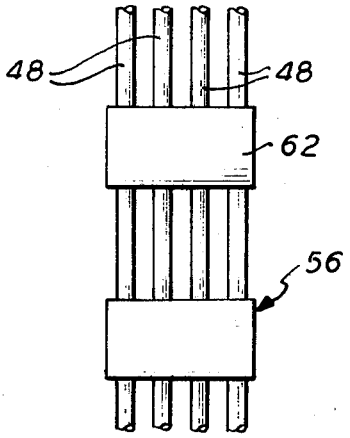
FIG. 6B is a side view illustrating a strand of wire such as that shown in FIG. 5B as that strand is uncoiled from the mandrel.

After the plating is completed, the insulator material 52 is removed from the wire coil 47 by spraying the coil with a solvent or immersion in a solvent bath. The mandrel 40 with the exposed wires 46, 48, and 50 is then exposed to an etchant spray, as used in making printed circuits. The mandrel is rotated during the spray while the etchant removes the copper wire exposed by the areas not plated by the joining metal 54 covered with the layer of etchant resistant material 62. The strand 56 is then removed from the mandrel as described above to form the four contact, spaced strand shown in FIG. 6B. The copper wires 50 having been etched away as described above.

An alternative is also available for forming a spaced multi-wire contact wherein the use of a noble metal may be avoided. If the conductive wires 46 are formed from Paliney 7, the metal joiner 54 from nickel, and the separator wires 48 from copper, an etchant such as ammonium pensulfate may be used which will not etch the Paliney 7 wire 48 of nickel joiner 54, but will readily etch the copper wire 50. In this case, the protective layer of etch resistant metal 62 may be eliminated.

Other variations of the embodiments described above are possible. For example, the nonconductive wire 46 could be flattened with a thickness equal to the diameter of the conductive wire 44 and a height greater than the conductive wire to provide a separator for the plated joining metal 54. The metal portion 54 need not be perpendicularly arranged to the conductive wires. The spacing of spring contacts formed by the process of FIGS. 5B and 6B may be varied by using a flattened copper wire 50 to increase the spacing or, if flattened so as to decrease its cross-sectional thickness parallel to the surface of the mandrel, to decrease the spacing. The process described may be used with wire contacts whose diameters vary between 0.001 to 0.010 inches and with sets of flat helical strands of up to 40 wires. Clearly other variations are also possible and will become obvious to those skilled in the art after considering the description set forth above.

The embodiments of the invention in which an exclusive property or privilege is claimed are defined as follows:

1. A method of forming multi-wire contacts comprising the steps of:

wrapping a plurality of wires including conductive wires and at least one nonconductive wire upon a mandrel to form helical sets of said wires into a single layered coil thereon;

covering longitudinal strips of said coil with circumferentially spaced conductive metal strips which cover said plurality of conductive wires forming said helical sets of wire and do not cover said at least one nonconductive wire;

cutting at least one helical set of said conductive wires including said at least one nonconductive wire;

unwrapping said plurality of wires freed by said cutting of at least one helical set of said conductive wires including said at least one nonconductive wire in a continuous flat strand including only said conductive wires covered by said conductive metal strips; and forming said continuous flat strand into individual multi-wire contacts.

2. A method of forming multi-wire contacts as claimed in claim 1 comprising the additional step of:

rolling said continuous flat strand upon a reel for storage prior to the step of forming said continuous flat strand into said multi-wire contacts.

3. A method of forming multi-wire contacts as claimed in claim 1 wherein the step of forming said continuous flat strand into multi-wire contacts includes;

shaping the freed ends of said plurality of conductive wires forming said strand;

cutting said plurality of conductive wires to separate said shaped wire ends and at least one of said conductive metal strips; and heat-treating said separated wire ends and conductive metal strips to complete said multi-wire contacts.

4. A method of forming multi-wire contacts as claimed in claim 1 wherein the step of cutting at least one helical set of wires includes cutting along a line parallel to said longitudinal strips of said conductive metal.

5. A method of forming multi-wire contacts comprising the steps of:

wrapping a plurality of conductive wires including etch resistant conductive wire and easily etched conductive wire, and at least one nonconductive wire upon a mandrel to form a helical set of said wires into a single layered coil on said mandrel;

covering said coil with longitudinal strips of circumferentially spaced, etch resistant conductive material which covers said helical set of said plurality of etchresistant and easily etched conductive wires and does not cover said at least one nonconductive wire;

exposing said coil to an etching solution to etch away said easily etched conductive wires not covered by said longitudinal strips of etch resistant conductive material;

cutting one helical set of said etch resistant conductive wires and said at least one nonconductive wire;

unwrapping said helical set of said etch resistant conductive wires and said at least one nonconductive wire in a continuous flat strand including only said etchresistant conductive wires held in spaced relationship by said longitudinal strips; and forming said flat strand into multi-wire contacts.

6. A method of forming multi-wire contacts as claimed in claim 5 additionally comprising:

wrapping said mandrel with a plurality of conductive wires including an etch resistant noble metal wire and an easily etched copper wire and separating each helical set of said conductive wires with a single nonconductive wire;

covering said coil formed on said mandrel with longitudinal strips of plated metal and further covering said strips with a layer of etchresistant noble metal; and exposing said coil to an etching solution to etch away said copper wire.

7. A method of forming multi-wire contacts comprising the following steps:

wrapping a plurality of conductive wires and a nonconductive wire about a mandrel to form a helical set of said wires into a single layered coil thereon;

masking longitudinal circumferentially spaced areas of said coil surface with an insulator material, leaving the remaining coil surface unmasked;

plating said single layered coil with conductive metal for forming longitudinal circumferentially spaced conductive metal strips on said unmasked coil surface, said spaced conductive metal strips being uniformly interrupted by said nonconductive wire;

washing said plated coil to remove said masking insulator material;

cutting one helical set of said plurality of conductive wires and said nonconductive wire along a cutting line parallel to said longitudinal circumferentially spaced conductive metal strips;

unwinding said helical set of said plurality of conductive wires and said nonconductive wire from said coil into a continuous nonconductive wire and a continuous flat strand of said plurality of conductive wires, whose ends were formed by said cutting and which are joined by said spaced conductive metal strips interrupted by said nonconductive wire;

forming said joined flat strand of said plurality of conductive wires into individual multi-wire contacts by shaping said freed ends of said conductive wires, cutting said conductive wires adjacent and parallel to said spaced conductive metal strips, and heat-treating said conductive wires wherein the steps of shaping, cutting, and heat-treating may be carried out in the order desired.

8. A method of forming multi-wire contacts as claimed in claim 7 comprising the additional steps of:

disposing of said continuous nonconductive wire; and rolling said continuous flat strand of said plurality of joined conductive wires onto a reel for storage prior to said shaping, cutting and heat-treating steps.

* * * * *